US005971833A

United States Patent [19]

Rasmussen et al.

[11] Patent Number: 5,971,833

[45] Date of Patent: Oct. 26, 1999

[54] INVERTIBLE PLAYSET

[75] Inventors: Russell G. Rasmussen; Virginia M. Bala, both of Petaluma, Calif.

[73] Assignee: Hasbro, Inc., Pawtucket, R.I.

[21] Appl. No.: 09/016,298

[22] Filed: Jan. 30, 1998

[51] Int. Cl.[6] ..... A63H 3/52; G09F 1/08

[52] U.S. Cl. ..... 446/478; 40/539; 446/149

[58] Field of Search ..... 446/478, 477, 446/476, 479, 482, 487, 489, 321, 147, 148, 149, 150, 151, 152; 40/428, 539

[56] References Cited

U.S. PATENT DOCUMENTS

| | | | |
|---|---|---|---|
| 1,614,923 | 1/1927 | Honti | 446/149 |
| 1,966,986 | 7/1934 | Martin | 446/321 |
| 2,155,193 | 4/1939 | Johntz | 446/149 |
| 2,749,657 | 6/1956 | Lohnes . | |
| 2,872,753 | 2/1959 | Fenton . | |
| 3,049,814 | 8/1962 | McLain | 446/489 X |
| 4,313,270 | 2/1982 | Volkert et al. . | |
| 4,342,173 | 8/1982 | Otake . | |
| 4,516,948 | 5/1985 | Obara | 446/434 |
| 4,599,078 | 7/1986 | Obara | 446/487 X |
| 4,668,205 | 5/1987 | Choy et al. | 446/487 X |
| 4,833,802 | 5/1989 | Volkert | 40/359 X |
| 4,969,851 | 11/1990 | Rasmussen | 446/441 X |
| 5,004,445 | 4/1991 | Coleman et al. . | |
| 5,228,225 | 7/1993 | Lee | 446/489 X |
| 5,329,714 | 7/1994 | Lee . | |
| 5,435,769 | 7/1995 | Bertrand . | |
| 5,562,520 | 10/1996 | Pridonoff . | |
| 5,682,999 | 11/1997 | Larson . | |

FOREIGN PATENT DOCUMENTS

| | | | |
|---|---|---|---|
| 154722 | 1/1954 | United Kingdom | 446/321 |
| 2159721 | 12/1985 | United Kingdom . | |

*Primary Examiner*—D Neal Muir
*Attorney, Agent, or Firm*—Fish & Richardson, P.C.

[57] ABSTRACT

A playset toy provides multiple play environments selected by inverting the toy. The toy includes a playset body and parts attached to the body. The parts are constructed to alter their position relative to the body upon inversion such that inversion conceals one play environment and reveals another play environment.

24 Claims, 12 Drawing Sheets

INVERTIBLE PLAYSET

BACKGROUND

This invention relates to children's playsets.

Playsets offer children different play environments. A playset may include a three-dimensional structure and themed miniatures. A traditional doll house, for example, may include different rooms with appropriate miniature furnishings.

SUMMARY

In one aspect, generally, a playset toy provides multiple play environments selected by inverting the toy. The toy includes a playset body and attached parts. The parts are constructed to alter their position relative to the body upon inversion, so as to conceal one play environment and revealing another.

Implementations may include one or more of the following features. The parts may be configured to suggest different environments on opposite part surfaces. The parts may include a movable flap that conceals a body portion behind the flap. The toy may further include a movable platform flexibly attached to the movable flap. The parts may also include a pair of lids attached on opposite ends of the body, and a connection between the lids that hold the lids in positions relative to the body. The connection may hold one lid in a substantially vertical position above the body. The parts may include shelves constructed to either fold-out from the body or to rest more compactly against the body depending on the vertical orientation of the toy. The shelves may hold other objects. The environments provided by the toy may include miniatures attached to the playset. The environments may depict rooms or occupational settings. The different environments may be complementary. The parts may include openings that permit objects to pass between the different environments.

In another general aspect, a playset toy provides different play environments that can be interchanged by inverting the toy. The toy includes a vertical body that has different gravity operated structures. The gravity operated structures are oriented such that some lie flush against the vertical body and others extend outward depending on the vertical orientation of the vertical body. The toy may further include a base that surrounds and can move along the vertical body.

Other features and advantages will become apparent from the following description, including the drawings, and from the claims.

DETAILED DESCRIPTION

Figure 1:
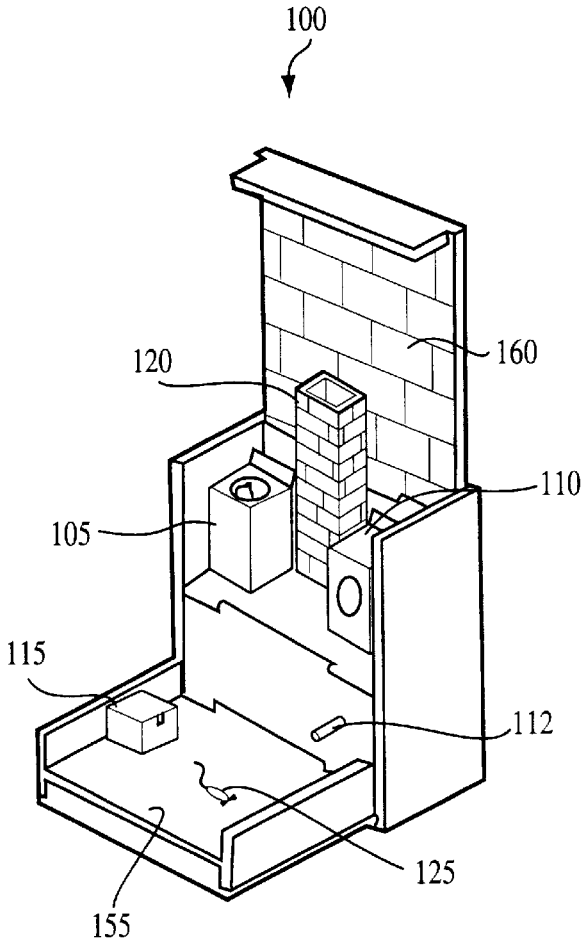
FIGS. 1 and 2 are perspective views illustrating different environments provided by an invertible playset.
Figure 2:
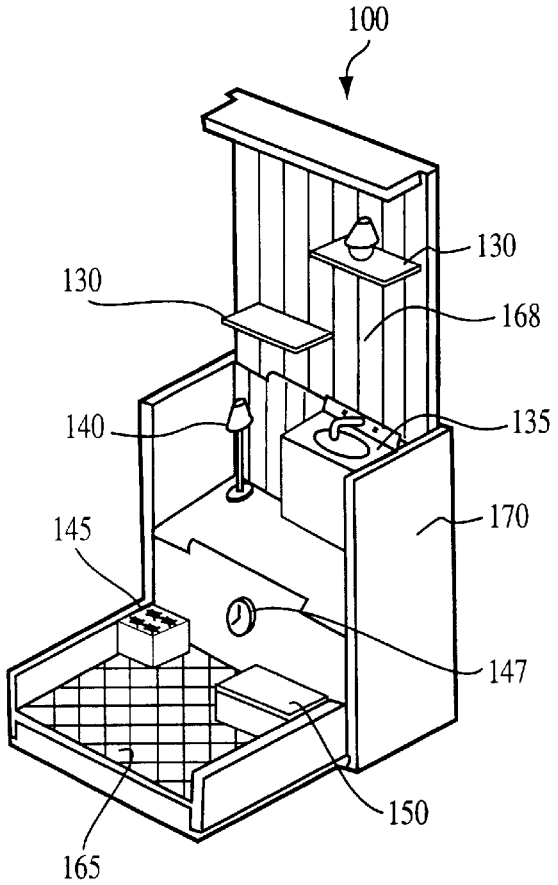

Referring to FIGS. 1 and 2, an invertible playset 100 provides two different playset environments such as the garage themed environment of FIG. 1 and the kitchen themed environment of FIG. 2. The different environments can include three dimensional action miniatures attached to the playset surfaces. For example, the garage environment of FIG. 1 includes a washing machine 105, a dryer 110, a storage box 115, a water pipe 112, a chimney stack 120, and a rat 125. The kitchen environment of FIG. 2 includes kitchen shelves 130, a sink 135, a lamp 140, an oven 145, a clock 147, and a refrigerator 150. Many of the miniatures have functioning parts. For example, the dryer 110 has an opening door that provides a hiding place for action figures. Other details etched into the playset further enhance the environments. For example, in FIG. 1, the garage environment suggests concrete block floors 155 and walls 160, while in FIG. 2, the kitchen playset shows a tiled floor 165 and wood panel walls 168.

Inverting the invertible playset 100 changes the environment. That is, turning the playset 100 upside down can conceal the garage environment of FIG. 1 and reveal the kitchen environment of FIG. 2, and vice-versa. This provides children with multiple play environments in a single compact toy. Child interest in the playset stems not only from the multiple environments, but also in the mechanisms that provide the invertible capability.

Figure 3:
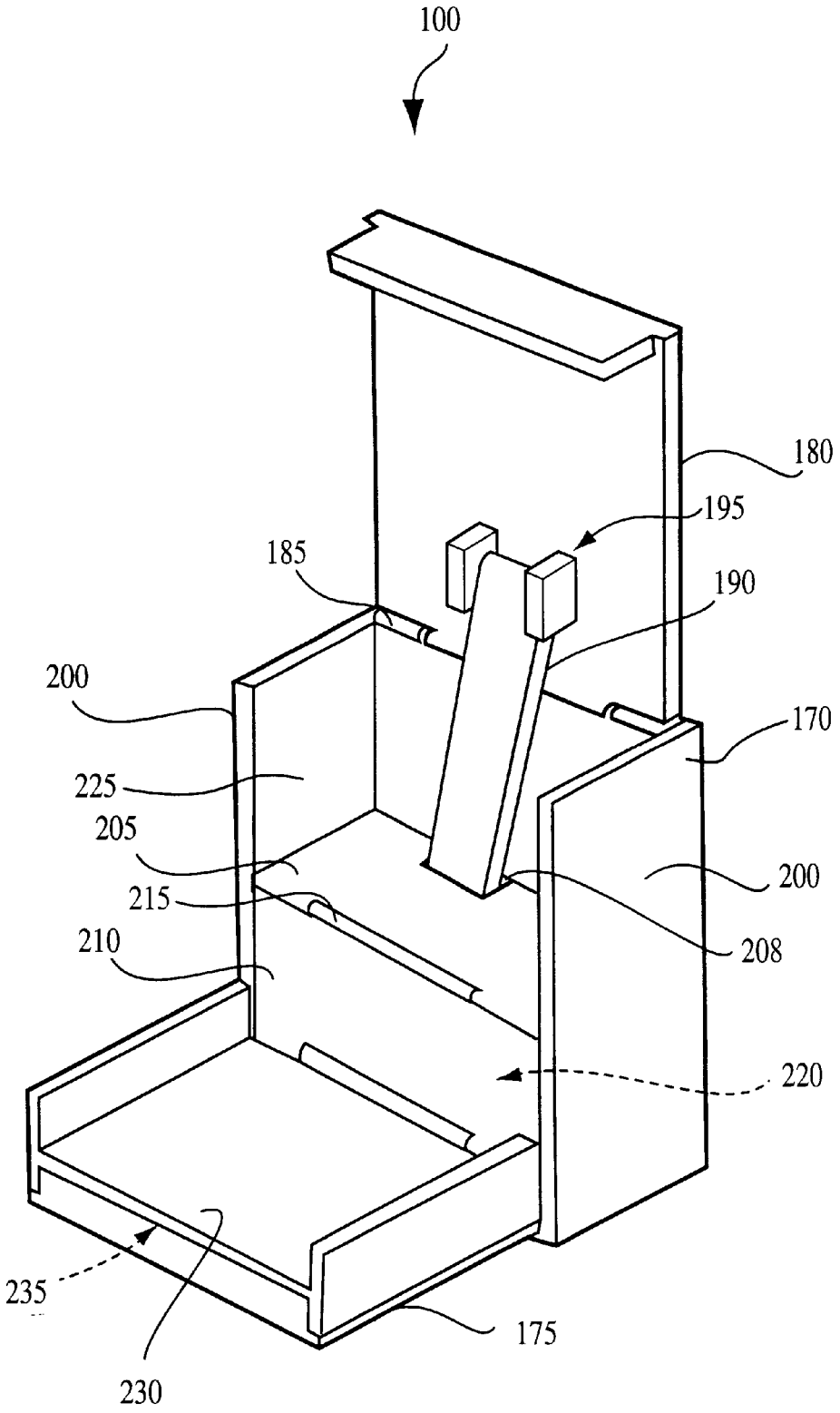
FIG. 3 is a perspective view of an invertible playset.

Referring to FIG. 3, an invertible playset 100 includes many gravity operated components. That is, the vertical orientation of the invertible playset dictates the alignment of parts and which faces of the parts are exposed.

The invertible playset includes a playset body 170 and lids 175 and 180. Hinges 185 connect the lids 175 and 180 to opposite ends of the playset body 170. As shown, one lid 180 extends vertically above the body 170 while the other lid 175 rests on a ground surface. Inversion of the playset 100 exchanges the orientations of the lids 175 and 180. That is, after inversion, the lid 175 that formerly rested on the ground extends vertically above the body, and the lid 180 that formerly extended vertically above the body, rests horizontally on the ground (FIGS. 8–11 illustrate the motion of the lids during playset inversion). A strip 190 connects the lids 175 and 180 such that the strip 190 buttresses the lid 180 that extends vertically. The strip attaches to the lids 175 and 180 at hinges 195 that permit the strip to rotate relative to each lid. The strip 190 and associated hinges 195 can be concealed by environment miniatures, such as chimney stack 120 shown in FIG. 1.

The playset body 170 includes side panels 200 and a stationary mid-section shelf 205. The shelf 205 includes a cutout 208 sized and positioned so that the shelf 205 does not interfere with the strip. A flap 210 is attached to the shelf 205 by a hinge 215. The flap 210 conceals the body portion 220 below the shelf 205 and reveals the body portion 225 above the shelf. The hinged flap 210 falls after inversion to switch the body portions 220 and 225 that are concealed and revealed (FIGS. 4–7 illustrate the motion of the flap 210 during playset inversion.)

A platform 230 is attached by a hinge to the end of flap 210. The platform 230 rests upon the base lid 175. The platform 230 and lids 175 and 180 are shaped such that when the platform 230 rests upon a lid 175 or 180, the parts interlock to conceal the playset portion 235 under the platform 230. Upon inversion, the platform 230 falls to the opposite side of the playset body 170. (FIGS. 4–7 illustrate the motion of the platform 230 during playset inversion.)

Figure 4:
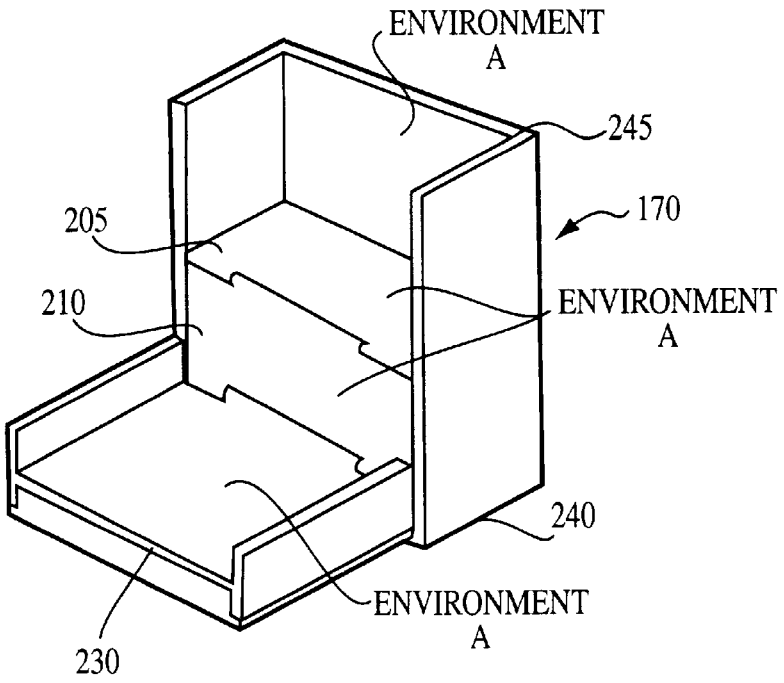
FIGS. 4–7 are perspective views illustrating motion of a playset flap and platform during playset inversion.
Figure 5:
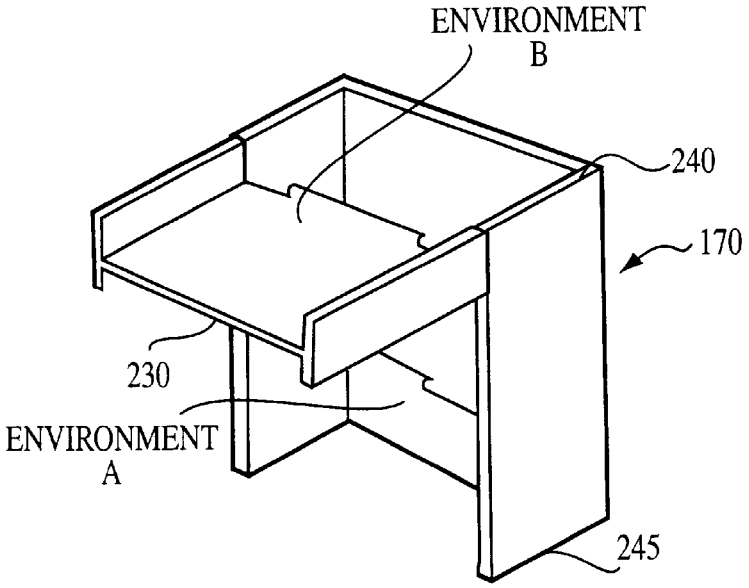
Figure 6:
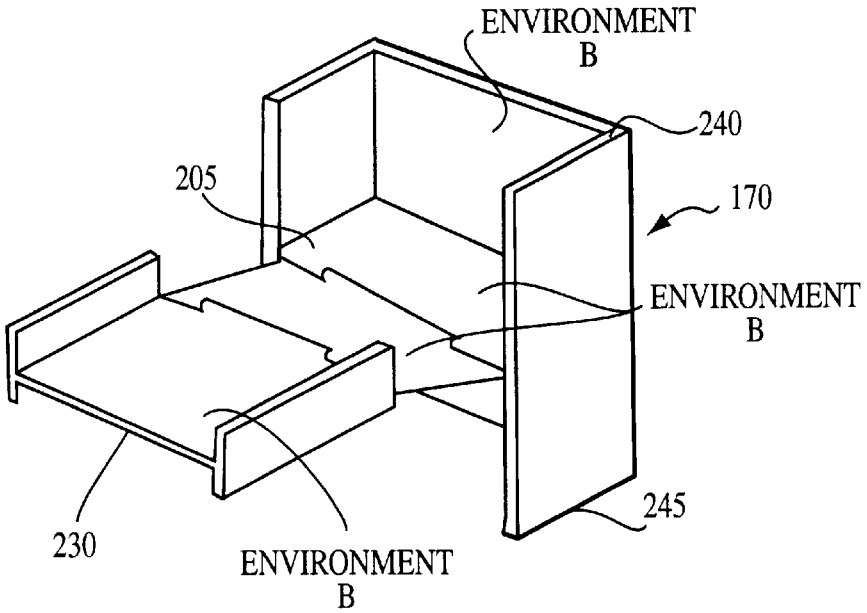
Figure 7:
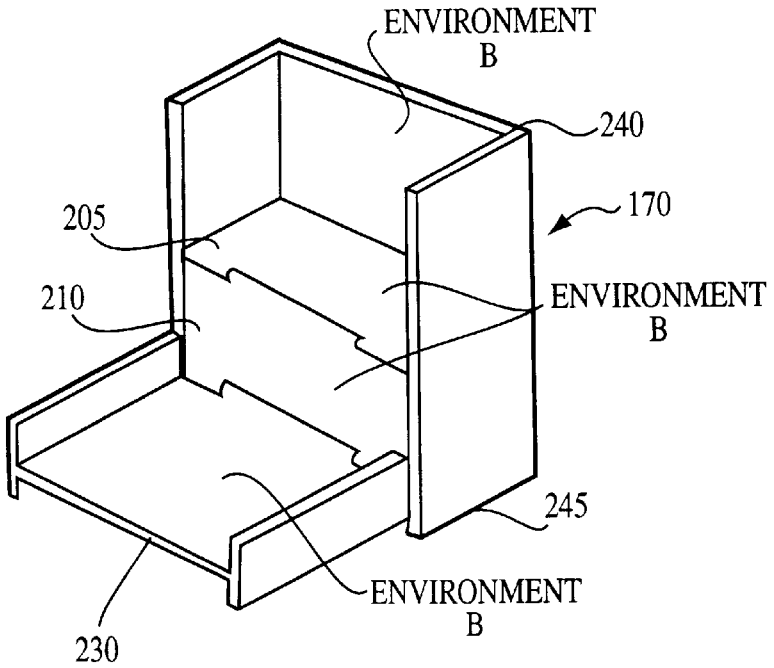

Referring now to FIGS. 4–7, the movement of the platform 230 and flap 210 during playset inversion is shown in isolation from other playset parts. In FIG. 4, the platform 230 rests horizontally on the ground at one end 240 of the body 170. The flap 210 that connects the platform 230 to the body 170 hangs downward. FIG. 5 shows the platform 230 and flap 210 after inversion. Inversion exchanges the positions of the body ends 240 and 245 (i.e., before inversion end 240 rests on the ground, after inversion end 245 rests on the ground). In FIG. 6, the platform 230 and flap 210 hinges permit both parts to fall. Finally, in FIG. 7, both platform 230 and flap 210 rest at the opposite end 245 of the body. Considerable variation in motion can occur as the parts fall (i.e., the platform can change its angular relationship to the flap as it falls). However, FIGS. 4 and 7 nevertheless show the final result of inversion. Comparing FIG. 4 to FIG. 7 shows how inversion completely changed the exposed playset surfaces.

Figure 8:
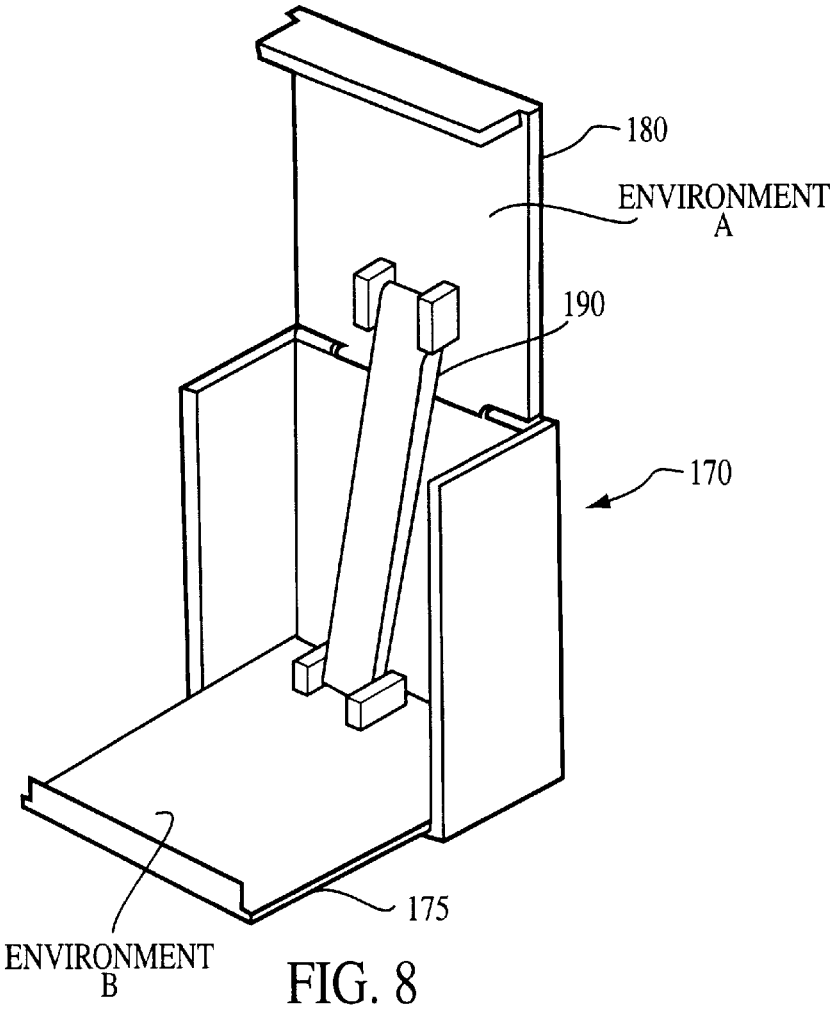
FIGS. 8–11 are perspective views illustrating the motion of a pair of lids during playset inversion.
Figure 9:
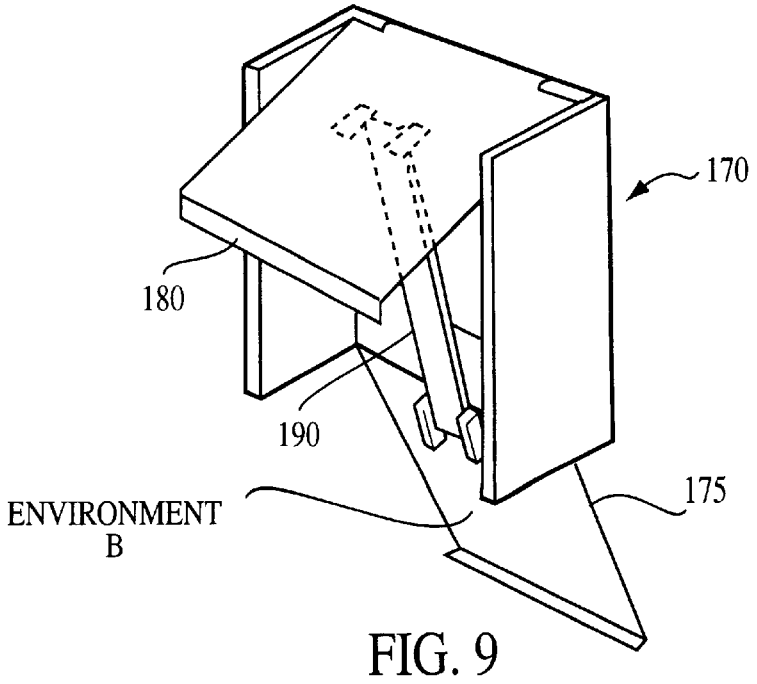
Figure 10:
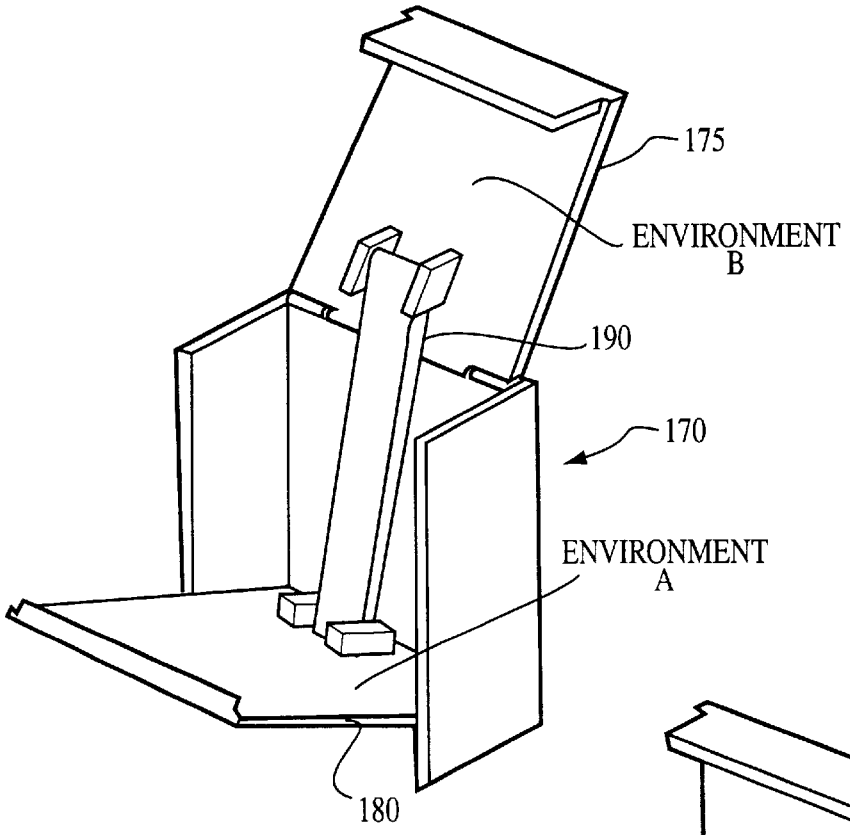
Figure 11:
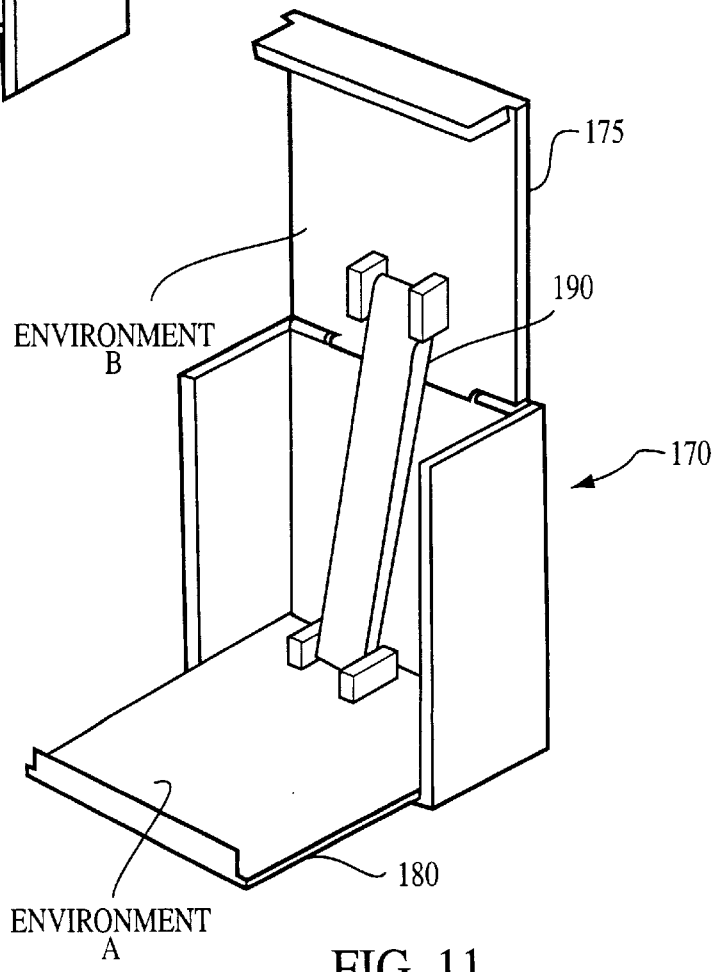

FIGS. 8–11 show movement of the lids 175 and 180 and connecting strip 190 during playset inversion. In FIG. 8, the base lid 175 rests on the ground perpendicular to the body 170. The connecting strip 190 buttresses the other lid 180 in a vertical position above the body 170. As shown in FIG. 9, lifting the body 170 causes the base lid 175 to fall. The base lid 175 also pulls the top lid 180 down. Momentum causes the top lid 180 to dip into the body 170 where friction between the top lid 180 and the sides of the body 170 catches the lid 180. In FIG. 10, after inversion, friction between lid 180 and the sides of the body 170 prevents the embedded lid 180 from falling. In FIG. 11, the impact of placing the body 170 upon the ground dislodges the embedded lid 180 from within the body 170, which leaves the lid 180 resting on the ground. After inversion, the vertical flap 180 of FIG. 8, is now the base flap 180 of FIG. 11. Comparing FIG. 8 to FIG. 11 illustrates how inversion of the playset changes the environment displayed by the vertically standing lid (180 in FIG. 8 and 175 in FIG. 11).

Figure 12:
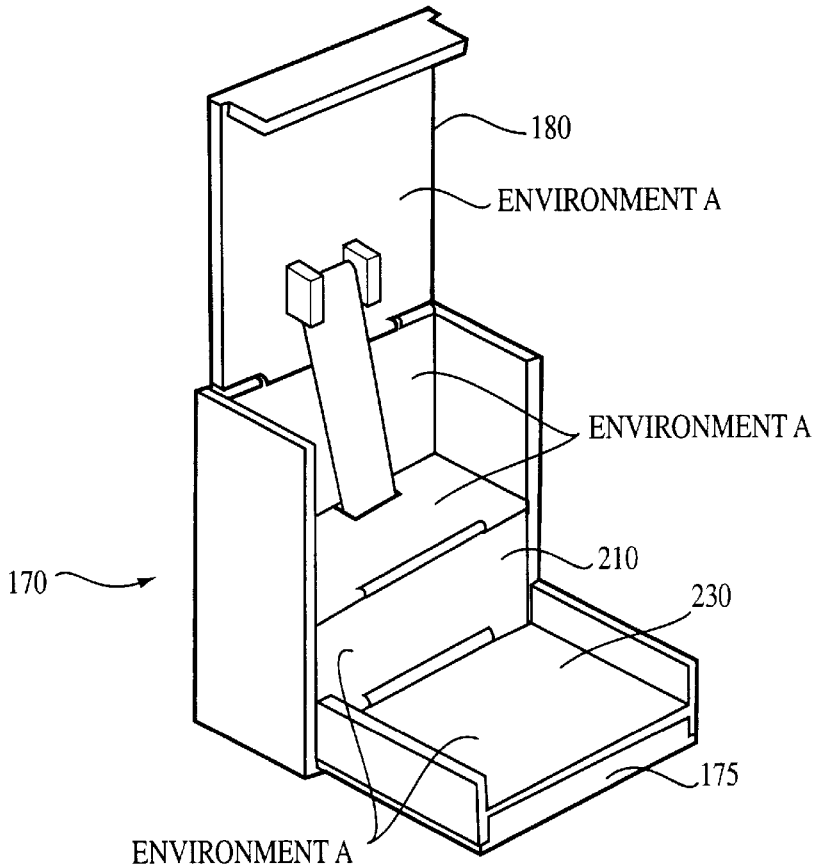
FIGS. 12–14 are diagrams illustrating the combined motion of the body flap, platform, and lids during playset inversion.
Figure 13:
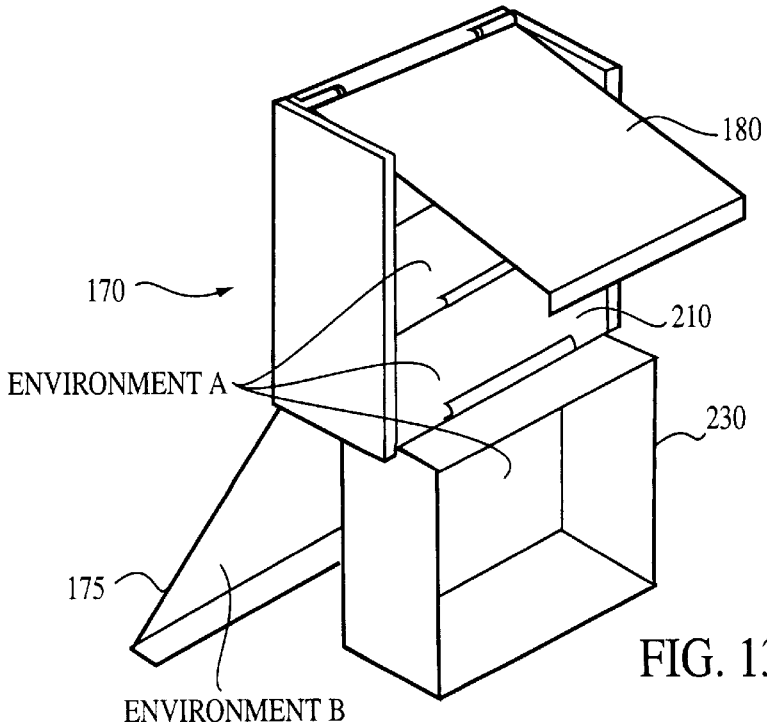
Figure 14:
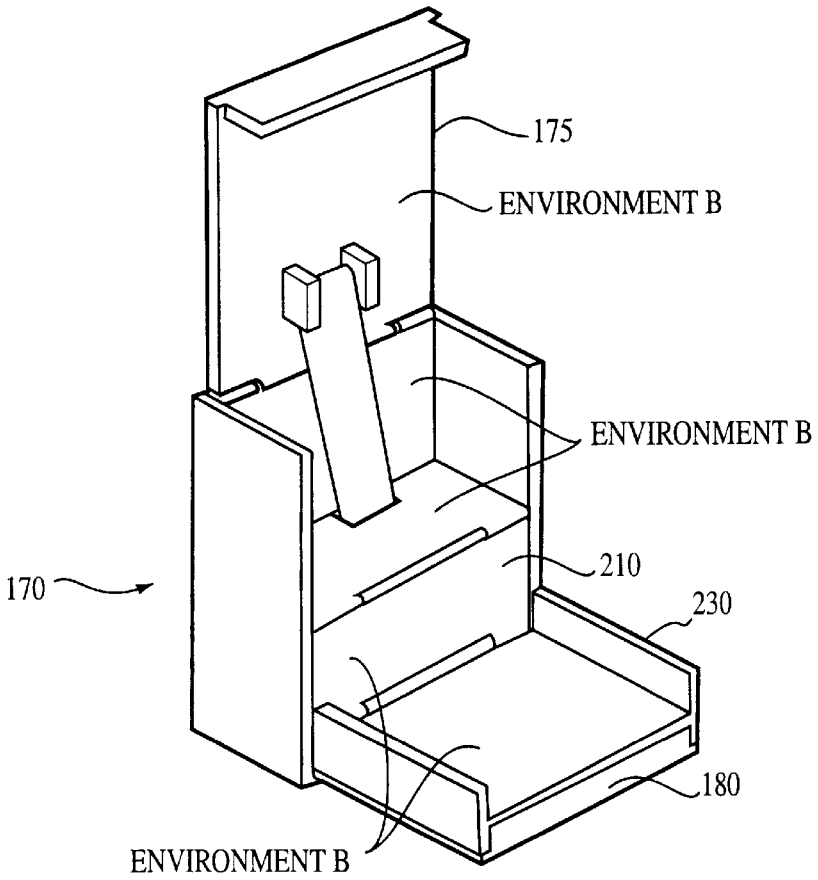

Referring to FIGS. 12–14, the movements of the platform 230, flap 210, and lids 175 and 180 occur simultaneously. In FIG. 12, the invertible playset provides a first set of exposed surfaces (labeled "Environment A"). In FIG. 13, lifting the invertible playset causes the platform 230 and bottom lid 175 to fall. In FIG. 13, after inversion, the platform 230 falls into the new bottom lid 180 and a new top lid 175 is propped vertically above the body 170. Thus, the playset exposes a new set of playset surfaces (Environment B) and conceals an old set of playset surfaces (Environment A).

Figure 15:
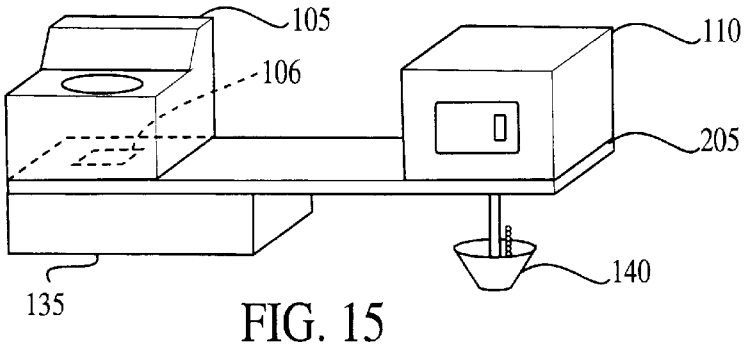
FIGS. 15–17 are diagrams illustrating placement of miniatures on opposite sides of invertible playset surfaces.
Figure 16:
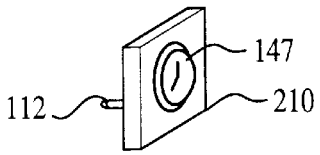
Figure 17:
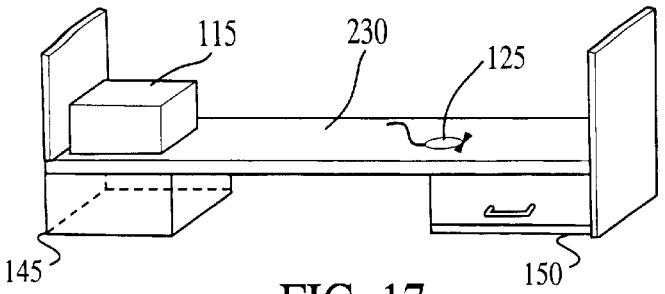

Referring to FIG. 15–17, the mechanisms described control exposure of different sides of playset surfaces. Miniatures can be positioned on the different surfaces sides to provide the different environments. In FIG. 15, one side of the body mid-section shelf 205 holds a washer 105 and dryer 110, while the other side holds the sink 135 and lamp 140. Similarly, in FIG. 16, one side of the flap 210 that hangs down the body features a water pipe 112 on one side and a clock 147 on the other. Likewise, in FIG. 17, one side of the platform 230 holds the storage box 115 and rat 125, while the other side holds the oven 145 and refrigerator 150. Since the objects appear on opposite surfaces, controlling which surface is exposed controls which objects are visible. This configuration also provides for interesting twists, for example, a hole 106 between the washer 105 and sink 135 provides a mechanism to hide a figure in one environment and retrieve the figure in another. One implementation even provides a dumb-waiter (not shown) that ferries figures between environments.

Figure 18:
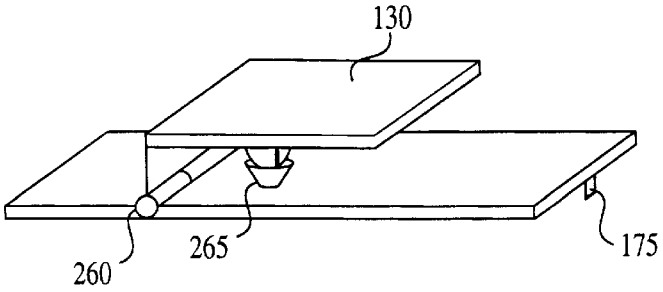
FIGS. 18–21 are diagrams illustrating gravity operated structures.
Figure 19:
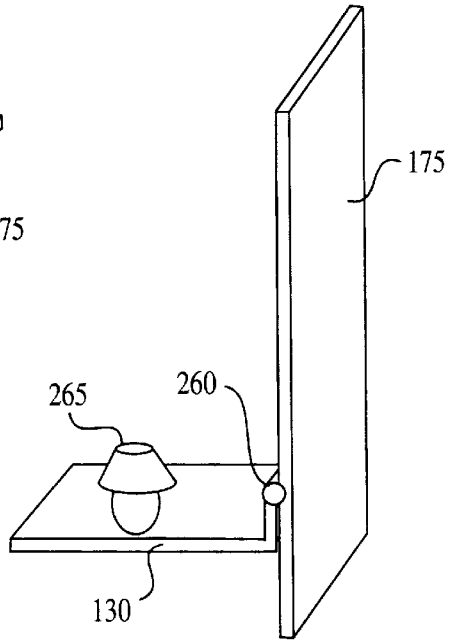
Figure 20:
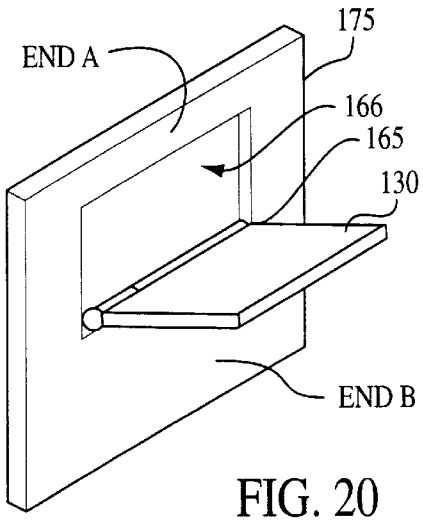

Referring to FIGS. 18–20, the invertible playset is constructed such that concealed pieces fit either within the area behind the body flap or between the bottom lid and the platform. Gravity operated objects can conserve space within the concealed areas. In FIGS. 18 and 19, a hinge 260 attaches an "L" shaped shelf 130 to a playset surface, such as lid 175. As shown in FIG. 18, when the playset surface lies horizontally, the elongated section of the shelf 130 lies parallel to the playset surface 175. Orienting the playset surface 175 vertically, as shown in FIG. 19, causes the shelf 130 to fall against the surface 175 and extend the shelf and its contents (e.g., a lamp 265) outward.

Figure 21:
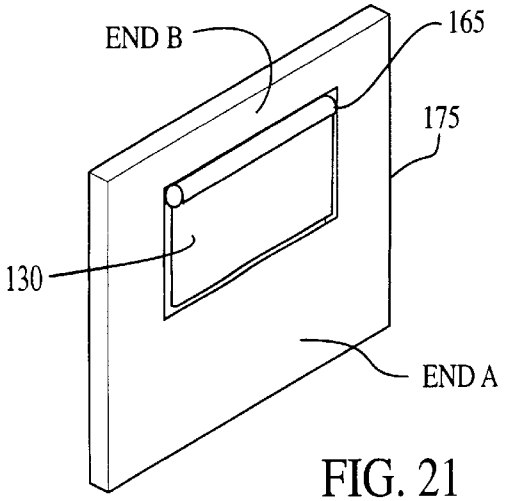

Referring to FIGS. 20 and 21, instead of using an "L" shape, a shelf could instead be fitted into a well in the surface. In FIG. 20, shelf 130, which is sized to fit within well 166, is propped horizontally by the ledge of surface 175. This produces both a shelf 130 and an opening 166 that can suggest a window. In FIG. 21, after inversion, the shelf 130 lies flush against the surface 165 inside the well 166.

Figure 23:
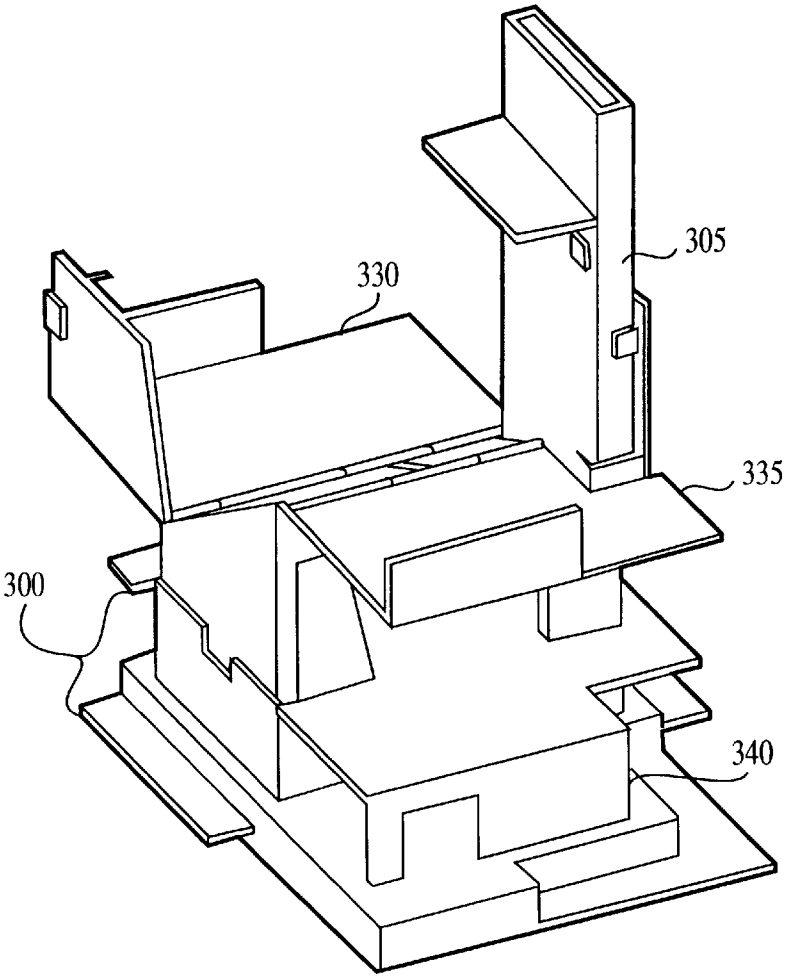
FIGS. 22 and 23 are perspective views illustrating two different environments provided by a different implementation of an invertible playset.
Figure 22:
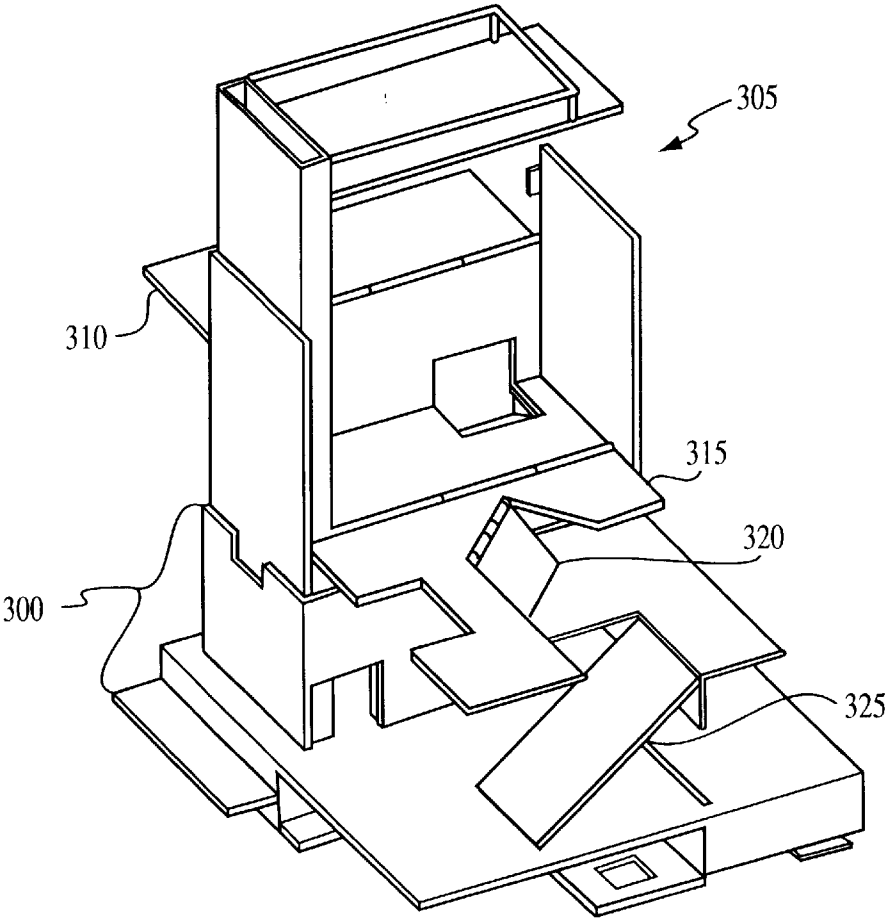

Referring to FIGS. 22 and 23, a different implementation of an invertible playset uses telescoping pieces arranged around a central column to produce different environments such as the industrial themed environment of FIG. 22 and the futuristic home setting of FIG. 23. The invertible playset includes a base 300 that surrounds a vertical body 305 and can move along the vertical body 305. The vertical body 305 includes different gravity operated structures 310, 315, 320, 325, 330, 335, and 340 that may telescope or be retracted based on the orientation of the playset. Some of the gravity operated structures include additional gravity operated structures to provide a sequence of telescoping structures. For example, as shown in FIG. 22, shelf 315 includes an additional shelf 320 that drops from shelf 315 after it opens.

The positions of the different structures change based on whether the playset is oriented as shown in FIG. 22 or FIG. 23. That is, the vertical orientation of the vertical body determines which structures lie flush to the body and which fold outward.

Figure 25:
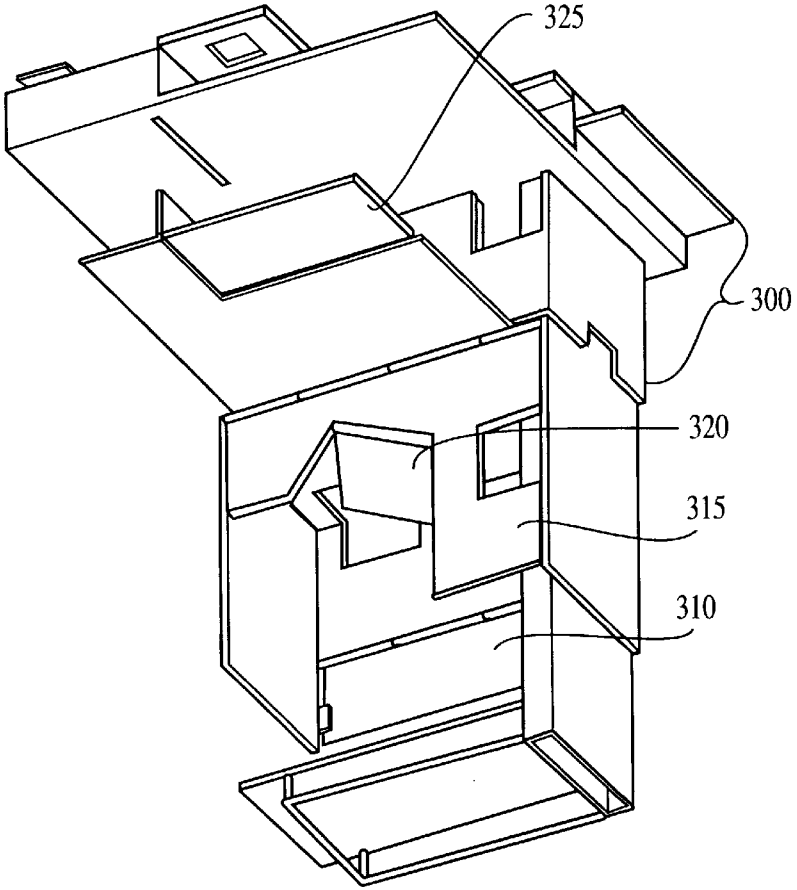
FIGS. 24–27 are perspective views illustrating the effect of inversion upon the invertible playset of FIGS. 22 and 23.
Figure 24:
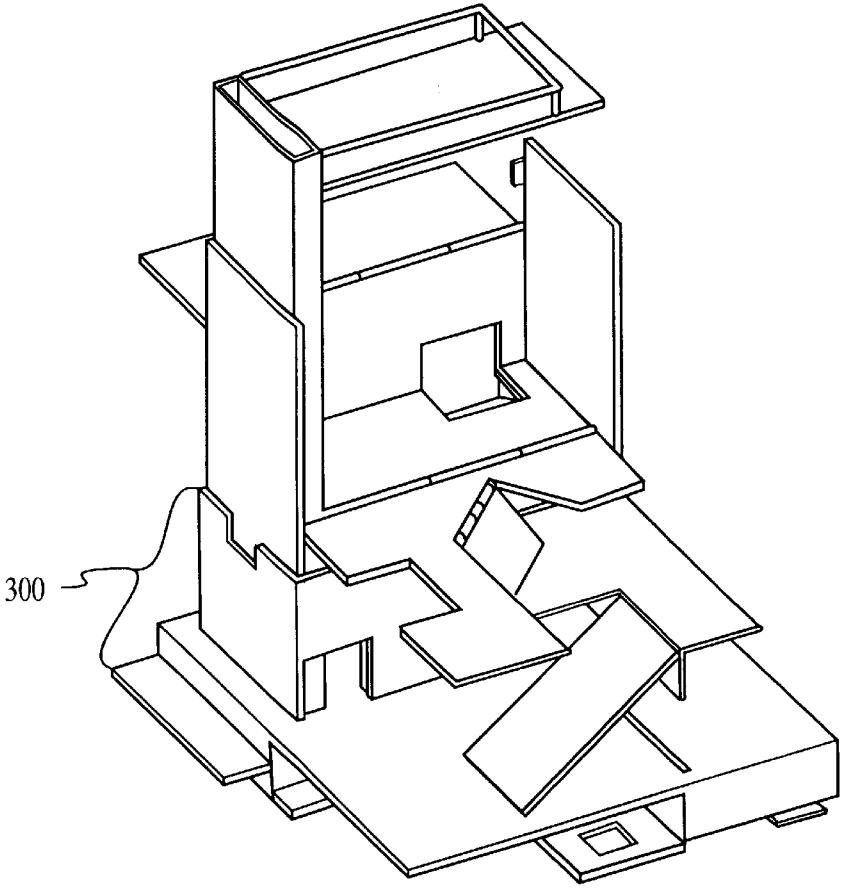
Figure 27:
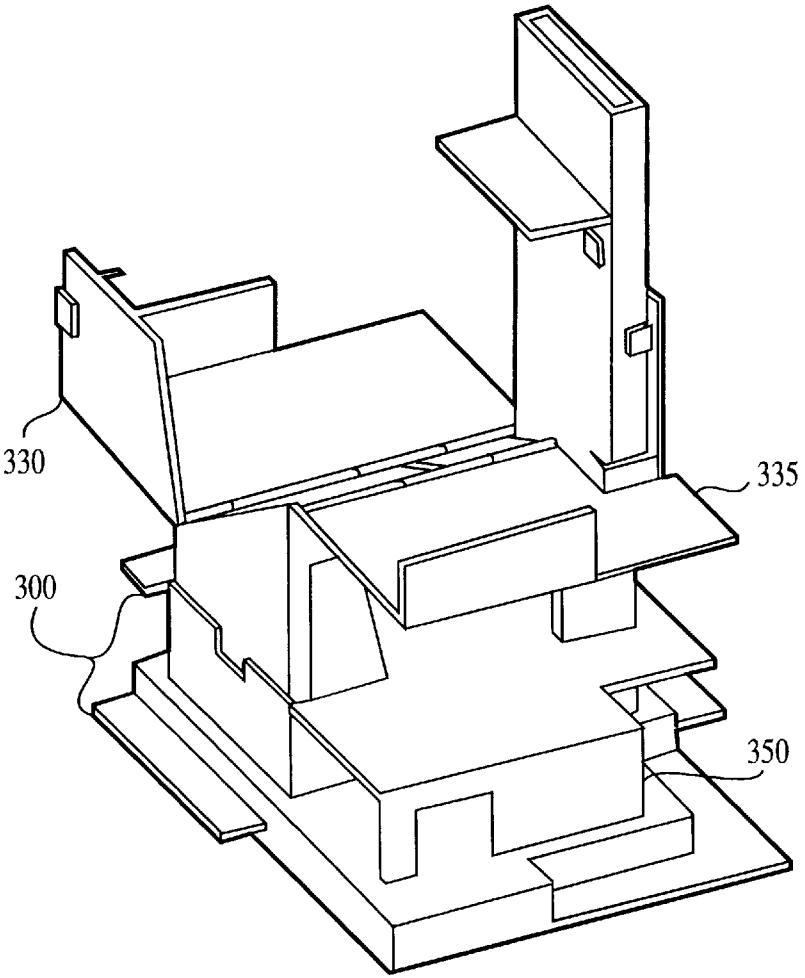
Figure 26:
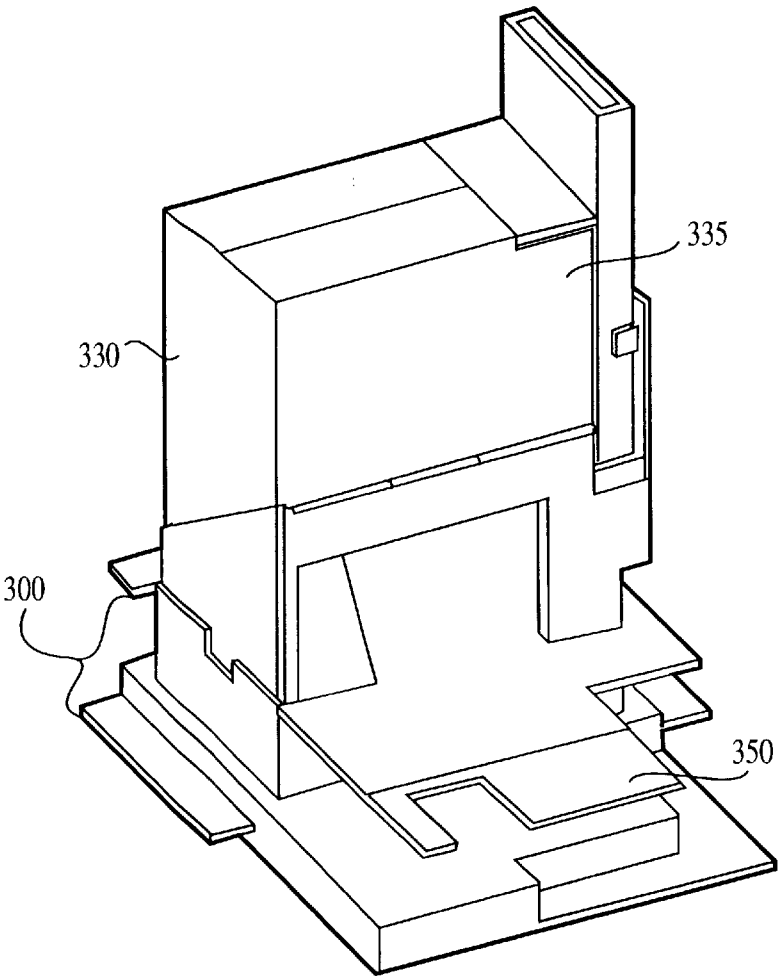

Referring to FIGS. 24–27, inverting the playset of FIG. 24 causes the formerly extended shelves to lie flush against the playset surfaces as shown in FIG. 25. This provides an unobstructed path over which to push the base 300 down the vertical body 305. After pushing the base 300 down, as shown in FIG. 26, the vertical body 305 reveals different gravity operated structures that unfold and produce a new environment in FIG. 27.

Other embodiments are within the scope of the following claims. The described mechanisms and techniques are not limited to playsets and may be applied, for example, to toy vehicles, figures, or preschool toys.

What is claimed is:

1. A toy that provides multiple play environments selected by inverting the toy, the toy comprising:

a playset body, and at least one rigid Part attached to the body, the part altering position relative to the body upon inversion, of the body the altered position causing the part to conceal one play environment and reveal another play environment.

2. The toy of claim 1 wherein the part comprises a part configured to suggest different environments on opposite part surfaces.

3. The toy of claim 1 wherein the at least one part comprises a movable flap that forms at least part of a surface that conceals a body portion behind the flap.

4. The toy of claim 3 further comprising a movable platform flexibly attached to the movable flap.

5. The toy of claim 1 wherein the at least one part comprises:

a pair of lids attached on opposite ends of the body, and a connection between the lids, the connection constructed to hold the lids in positions relative to the body.

6. The toy of claim 5 wherein the connection holds one lid in a substantially vertical position above the body.

7. The toy of claim 1 wherein the at least one part comprises shelves constructed to either fold-out from the body or to rest more compactly against the body depending on the vertical orientation of the toy.

8. The toy of claim 7 wherein the shelves hold other objects.

9. The toy of claim 1 wherein the environment comprises miniatures attached to the playset.

10. The toy of claim 1 wherein a first environment comprises a model of a room or occupational setting.

11. The toy of claim 10 wherein a second environment comprises a model of a room having a scale the same as the first environment and having different properties than the first environment.

12. The toy of claim 1 wherein the parts include openings that permit objects to pass between the different environments.

13. A toy that provides different playset environments that can be interchanged by inverting the toy, comprising:

a playset body comprising:

a back panel; and two side panels attached to the back panel; and a flap attached to the playset body, the flap altering position relative to the body upon inversion, the altered position causing the part to conceal one play environment and reveal another play environment.

14. The toy of claim 13 further comprising a platform flexibly attached to the flap, the platform being constructed with a different playset environment on either platform side, the platform being further constructed to expose a different platform side based on the vertical orientation of the toy.

15. The toy of claim 13 further comprising:

a pair of lids, each lid being flexibly attached to opposite ends of the playset body, and a connection between the lids constructed to maintain a supported lid's position relative to the playset body.

16. The toy of claim 13, wherein the playset body further comprises a shelf.

17. A playset toy that provides different playset environments that can be interchanged by inverting the toy, the toy comprising:

a playset body;

a flap flexibly attached to the playset body, the flap being constructed with a different playset environment on either flap side, the flap further being constructed to expose a different flap side and conceal different portions of the playset body based on the vertical orientation of the toy;

a platform flexibly attached to the flap, the platform being constructed with a different playset environment on either platform side, the platform being further constructed to expose a different platform side based on the vertical orientation of the toy;

a pair of lids, each lid being flexibly attached to opposite ends of the playset body; and a connection between the lids constructed to maintain a supported lid's position relative to the playset body.

18. A toy that provides different playset environments that can be interchanged by inverting the toy, comprising:

a vertical body that includes different gravity operated structures, the gravity operated structures oriented such that in a first vertical orientation a first set of structures lie substantially flush against the vertical body and a second set of structures extend radially outward, and in a second vertical orientation, the first set of structures extend radially outward and the second set lie substantially flush against the vertical body.

19. The toy of claim 18 further comprising a base that surrounds and can move along the vertical body.

20. The toy of claim 18 wherein the gravity operated structures themselves include gravity operated structures.

21. The toy of claim 20, wherein the side panels are substantially perpendicular to the back panel.

22. The toy of claim 16, wherein the flap attaches to the shelf.

23. The toy of claim 16, wherein the shelf comprises a shelf at substantially the vertical midpoint of the body.

24. The toy of claim 16, wherein the shelf comprises a shelf attached to the back panel and the two side panels.

* * * * *